United States Patent [19]

Szarka

[11] Patent Number: 4,697,640

[45] Date of Patent: Oct. 6, 1987

[54] APPARATUS FOR SETTING A HIGH TEMPERATURE PACKER

[75] Inventor: David D. Szarka, Duncan, Okla.

[73] Assignee: Halliburton Company, Duncan, Okla.

[21] Appl. No.: 820,497

[22] Filed: Jan. 16, 1986

[51] Int. Cl.[4] ..... E21B 33/128

[52] U.S. Cl. ..... 166/120; 166/136; 166/182

[58] Field of Search ..... 166/120, 122, 134, 136, 166/182, 214

[56] References Cited

U.S. PATENT DOCUMENTS

| | | | |
|---|---|---|---|
| 3,171,492 | 3/1965 | Cochran | 166/187 |
| 3,603,388 | 9/1971 | Current et al. | 166/120 |
| 4,127,168 | 11/1978 | Hanson et al. | 166/123 |
| 4,281,840 | 9/1981 | Harris | 277/117 |
| 4,302,018 | 11/1981 | Harvey et al. | 277/27 |
| 4,375,240 | 3/1983 | Baugh et al. | 166/387 |
| 4,438,933 | 3/1984 | Zimmerman | 277/9.5 |
| 4,441,721 | 4/1984 | Harris et al. | 277/26 |
| 4,487,258 | 12/1984 | Jackson et al. | 166/120 |
| 4,526,229 | 7/1985 | Dickerson | 166/120 |
| 4,531,581 | 7/1985 | Pringle et al. | 166/120 |

FOREIGN PATENT DOCUMENTS

| | | | |
|---|---|---|---|
| 2377518 | 8/1978 | France . | |
| 0759702 | of 1980 | U.S.S.R. | 166/120 |

*Primary Examiner*—Stephen J. Novosad
*Assistant Examiner*—William P. Neuder
*Attorney, Agent, or Firm*—James R. Duzan

[57] ABSTRACT

Apparatus for sealing a well bore annulus. A mandrel includes non-elastomeric packer elements disposed thereabout. A first annular piston is received about the mandrel and is slidable upwardly against the packer elements to seal the same in a well bore. A bi-directional slip assembly is disposed about the lower portion of the mandrel and a second annular piston is slidable along the mandrel above the slip assembly for setting the same in response to downward piston action. The mandrel includes a pair of bores for communicating internal mandrel pressure to both pistons. An increase in mandrel pressure causes the first piston to move upwardly thereby sealing the packer elements in the bore and causes the second piston to move downwardly thereby setting the slips.

13 Claims, 7 Drawing Figures

APPARATUS FOR SETTING A HIGH TEMPERATURE PACKER

BACKGROUND AND SUMMARY OF THE INVENTION

The instant invention pertains to apparatus for setting a packer in a well bore and more particularly to such apparatus for setting packers of the type having a nonelastomeric packer element.

It may sometimes be necessary to seal the annulus between a tubing string and a well bore in a high temperature environment. Such may be necessary when injecting steam into a well bore, when producing from a steam flood well or from a fire flood well, or in thermal or geothermal recovery wells.

Such high temperature environments may exceed the thermal limitation of a conventional elastomeric packer element which is incorporated in a conventional packer. Prior art devices exist which are intended to seal a well annulus in a high temperature environment, e.g., U.S. Pat. No. 4,375,240 to Baugh et al. and U.S. Pat. No. 4,302,018 to Harvey et al. U.S. Pat. No. 4,281,840 to Harris and U.S. Pat. No. 4,441,721 to Harris et al. disclose high temperature packers and are assigned to the assignee of the instant application.

Harris '840 and Baugh et al. each disclose packers having non-elastomeric packer elements which are set by applying a longitudinal force thereto. Such elements may form a tight seal when the packer is initially set; however, thermal expansion of the metal portions of the packer, especially longitudinal mandrel expansion, gradually reduces the force applied to the packer elements and thus the strength of the seal.

The Harris '721 disclosure includes a plurality of Belleville springs 78 disposed between the lower end of the packer element and a setting piston which applies a longitudinal force to the spring and packer elements. The spring is intended to maintain the packer elements compressed as the mandrel lengthens as a result of thermal expansion and as the total length of the packer elements decreases as a result of melting or degradation of low temperature packer elements. It has been found that the Belleville springs do not have sufficient travel to maintain sealing action in the presence of high temperatures.

Moreover, the Harris, '840 and Harris et al. '721 disclosures do not provide a mechanism for setting slips independently of the packer elements. The instant invention provides an advantage over the prior art by providing apparatus which continuously exerts a biasing force against a packer element and which provides for independent setting of slips, with both the biasing and slip setting forces being generated by internal hydraulic pressure.

The instant invention comprises a mandrel having a nonelastomeric packer element disposed thereabout. Ratchet means are associated with the mandrel for moving the packer element toward a well bore when the apparatus is received therein. Biasing means continuously urge the packer element into sealing engagement with the well bore. Slip means are associated with the mandrel for setting the same in the bore and are set independently from the packer elements responsive to an increase internal mandrel pressure.

These and other advantages of the instant invention will become more fully apparent when the following detailed description is read with reference to the accompanying drawings wherein:

FIG. 1A–1C comprises a cross-sectional view of a well packer incorporating the instant invention.

DETAILED DESCRIPTION OF THE PREFERRED EMBODIMENTS OF THE INVENTION

Figure 1A:
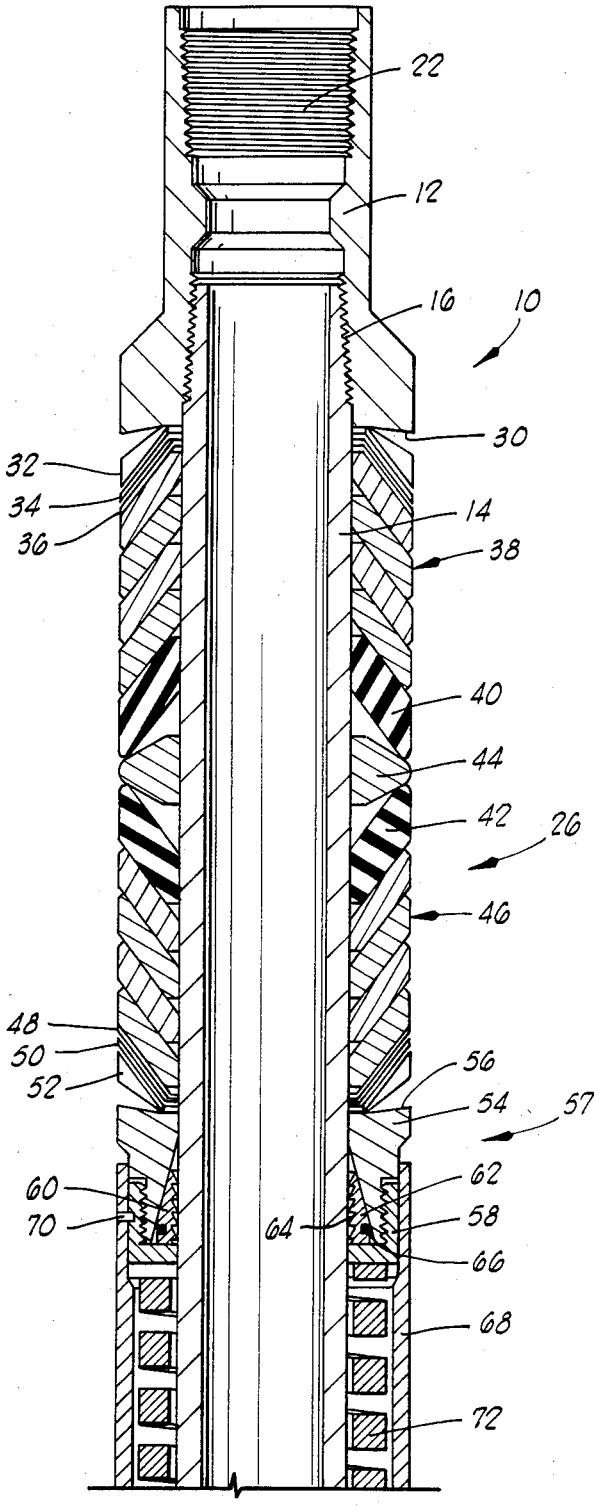
Figure 1B:
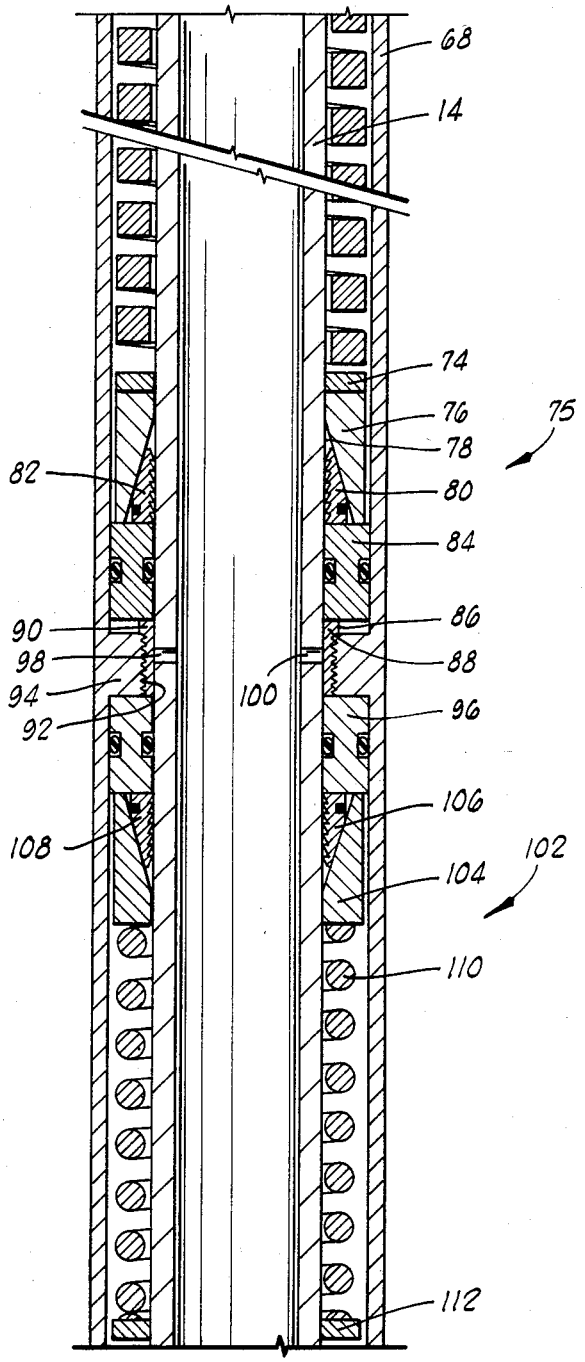

Turning now to the drawings and particularly to FIGS. 1A–1C and FIG. 2, indicated generally at 10 is a well packer constructed in accordance with the instant invention. Packer 10 includes an upper adapter 12 and a mandrel 14 threadably engaged thereto via threaded connection 16. A lower adapter 18 is threadably engaged to the lower end of mandrel 14 via threaded connection 20.

Upper adapter 12 includes a set of threads 22 for threadably engaging the upper adapter with a string of tubing. Lower adapter 18 includes a set of threads 24 which are also for engaging well packer 10 with tubing.

Figure 1C:
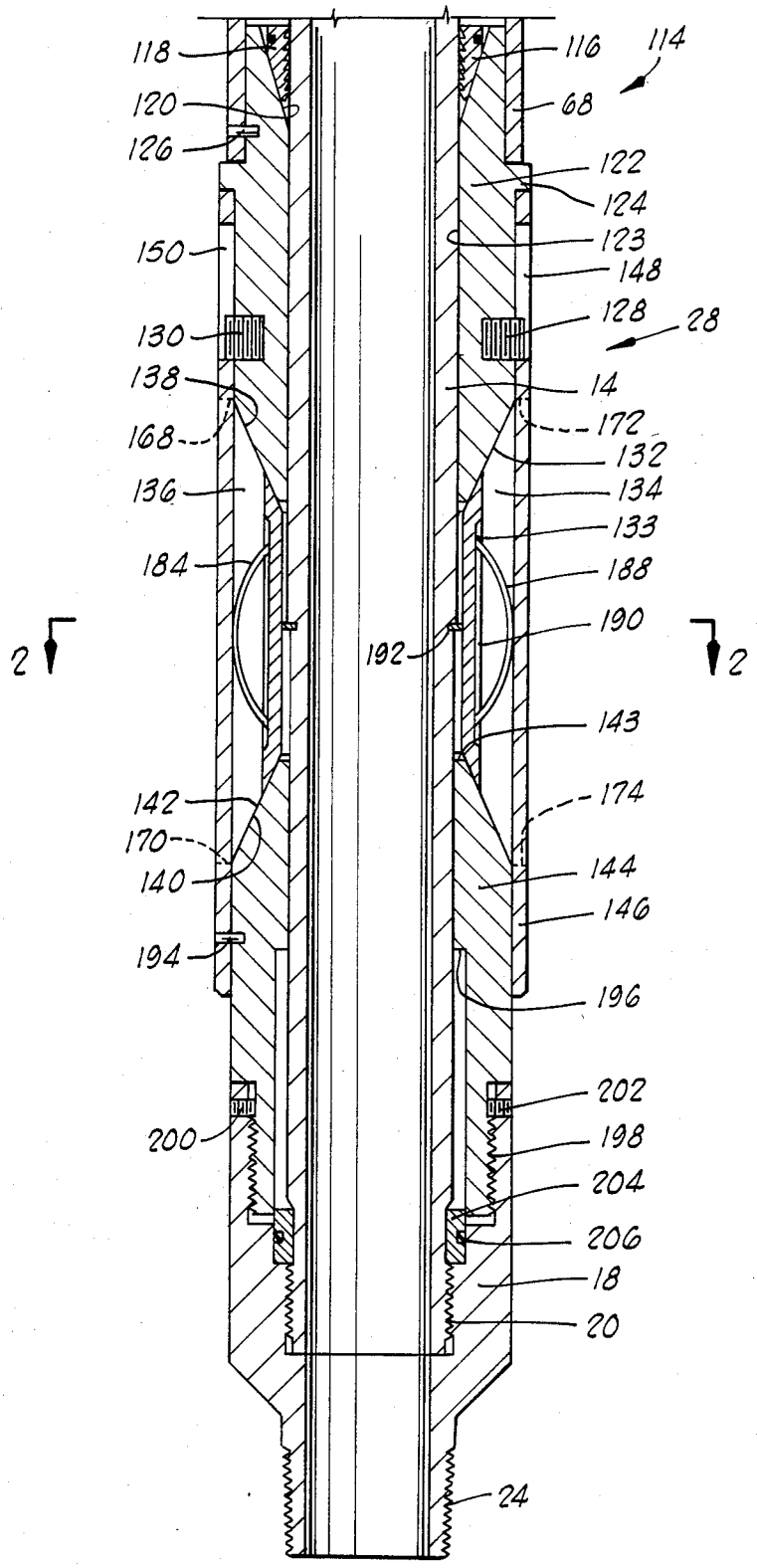

Indicated generally at 26, in FIG. 1A, is a packer element. Indicated generally at 28, in FIG. 1C, is a bidirectional slip assembly, also referred to herein as slip means for setting packer 10 in a well bore. As will later be more fully explained herein, well packer 10 is lowered into a well bore on a tubing string as a part thereof. Slip assembly 28 is used to fix the packer in the well bore while packer element 26 is urged into sealing engagement with the bore.

In FIG. 1A, upper adapter 12 includes a downward-facing surface 30, such being referred to herein as an upper shoulder. Packer element 26 is positioned beneath shoulder 30 and may be of the type disclosed in U.S. Pat. No. 4,441,721 issued to Harris et al. and assigned to the assignee of the instant application. Packer element 26 is constructed and operates in accordance with the invention of the Harris et al. patent which is incorporated herein by a reference. In order to understand the construction and operation of well packer 10 without reference to Harris et al., a brief description of the construction of packer element 26 follows.

Packer element 26 includes therein a set of upper packer shoes 32, 34, 36 which are slidably disposed on mandrel 14 and which abut against surface 30. High temperature packer segments 38 are disposed beneath the upper packer shoes and are frusto-conical in shape. Such are made of asbestos fiber impregnated with an intermediate hard thermal plastic such as Teflon, interwoven with Inconel wire. Low temperature packer segments 40, 42 are likewise frusto-conical in shape and are separated from one another by a high temperature packer ring 44, such being made of the same material as packer segments 38. Low temperature packer segments 40, 42 are made of a high temperature elastomeric such as hydrogenated nitrile or of a low melting point thermal plastic material such as ethylene vinyl acetate. Another set of high temperature packer segments 46, such being also frusto-conical in shape and oriented in the opposite direction to segments 38, are disposed between low temperature packer segment 42 and lower packer shoes 48, 50, 52. The lower packer shoes are disposed about mandrel 14 and are axially slidable therealong.

A lower packer shoe support 54 is axially slidable along the mandrel and includes an upward facing surface 56 which abuts against lower packer shoe 52. Indicated generally at 57 is an internal slip assembly. Included therein is a slip retainer 58 which is threadably engaged with a shoe support 54 as shown. Slip retainer 58 supports a number of internal slip segments, two of which are slip segments 60, 62, which are disposed about the circumference of the mandrel and which abut against the radially outer surface thereof. Each of the slip segments includes a plurality of downward-projecting slip teeth, like teeth 64 on slip segment 62, which engage the radially outer surface of mandrel 14 to prevent downward movement of the slips relative to the mandrel. A garter spring or O-ring 66 is received in a groove formed on the radially outer surface of each slip segment and biases all of the slip segments toward the mandrel.

The upper end of a piston case 68 is received over the outer surface of slip retainer 58 and a portion of the radially outer surface of lower packer shoe support 54. A plurality of shear pins, one of which is shear pin 70, are received through bores in piston case 68 and in slip retainer 58 to prevent relative axial movement between the slip retainer and the piston case until the pins are sheared.

An upper spring 72 is received within the annular space between mandrel 14 and piston case 68. The annular space in which upper spring 72 is received is defined at one end by the lower surface of slip retainer 58 and at the other end by a ring 74, such being also referred to herein as a spring shoe. Indicated generally at 75 is an internal slip assembly. Slip assembly 75 includes a slip bowl 76 which defines a space 78 between the radially outer surface of mandrel 14 and the radially inner surface of the slip bowl. Ring 74 rests on the upper end of slip bowl 76. A number of slip segments, like segments 80, 82, are received in space 78 and are biased against the mandrel in the same fashion as the slip segments in internal slip assembly 57 and are substantially identical thereto.

An annular piston 84 is disposed beneath internal slip assembly 75 and is sealingly moveable along the annular space between mandrel 14 and piston case 58. An annular shoulder 86 is disposed about the circumference of mandrel 14 and includes a pair of longitudinal slots 88, 90 formed therein. The lower portion of shoulder 86 includes a threaded outer surface (not visible) which is threadably engaged with threads 92 formed on the radially inner surface of a radially inner shoulder 94 on piston case 68. The lower end of piston 84 abuts against the upper surface of annular shoulder 86. A second piston 96 is substantially identical to piston 84 in structure and abuts against the lower surface of shoulders 86, 94.

A pair of radial bores 98, 100 are formed in mandrel 14 and permit fluid communication between the interior of the mandrel and slots 88, 90, respectively. Thus, fluid pressure is communicated between the interior of mandrel 14 to the lower surface of piston 84 and to the upper surface of piston 96.

Indicated generally at 102 is an internal slip assembly which includes a slip bowl 104 and slip segments, two of which are slip segments 106, 108. Internal slip assembly 102 is constructed in a manner similar to internal slip assembly 75 except that slip assembly 102 permits only downward movement of the slip segments, like slip segments 106, 108, relative to mandrel 14.

A second spring 110 is disposed in the annular space between mandrel 14 and piston case 68 which is defined at one end by the lower surface of slip bowl 104 and at the other end by a ring 112.

An internal slip assembly indicated generally at 114 in-cludes slip segments two of which are 116, 118. The slip segments in internal slip assembly 114 are supported by a radially inwardly tapered surface 120 formed on an upper spreader cone 122. The slip segments in internal slip assembly 114 may move only downwardly relative to mandrel 14.

Spreader cone 122 includes a radially outer shoulder 124 against which the lower end of piston case 68 abuts. Upper spreader cone 122 includes a cylindrical bore 123 therethrough through which mandrel 14 is received. The spreader cone is axially slidable along the mandrel; however, shear pins, one of which is shear pin 126, are received through a radial bore in piston case 68 and through a bore on the radially outer surface of the spreader cone thus preventing such movement until the pins are sheared.

Four retaining pins, like pins 128, 130, are threadably engaged in bores on the radially outer surface of spreader cone 122 which are disposed about the circumference of the cone at ninety-degree intervals. Spreader cone 122 includes a downwardly-directed tapered surface 132 about the circumference thereof. A downwardly directed shoulder 133 is formed on the lowermost portion of spreader cone 122.

Four slips, two of which are slips 134, 136 are disposed at ninety-degree angles about the circumference of the mandrel beneath spreader cone 122. A different number of slips may be necessary or desirable for different-sized tools embodying the invention. Slip 136 includes a tapered surface 138 which abuts against surface 132 on the upper spreader cone. Slip 136 further includes a lower tapered surface 140 which abuts against an upper tapered surface 142 formed on a lower spreader cone 144, such also being referred to herein as a lower shoulder. An upwardly directed shoulder 143 is formed on the uppermost portion of spreader cone 144.

A cylindrical slip housing 146 is received over the slips and over portions of upper and lower spreader cones 122, 144, respectively. Housing 146 includes four longitudinal slots at the upper end thereof, like slots 148, 150, through which each of the retaining pins, like pins 128, 130, extend. Slip housing 146 also includes eight additional slots 152, 154, 156, 158, 160, 162, 164, 166, such being viewable in FIG. 2. Each of slots 152–166 is opposite one of the slips, like slots 152, 166 are opposite slip 136 and slots 158, 160 are opposite slip 134, and extends for the length of its associated slip.

In FIG. 1C it can be seen that slot 152 includes upper and lower ends 168, 170, respectively while slot 158 includes upper and lower ends 172, 174, respectively.

Figure 2:
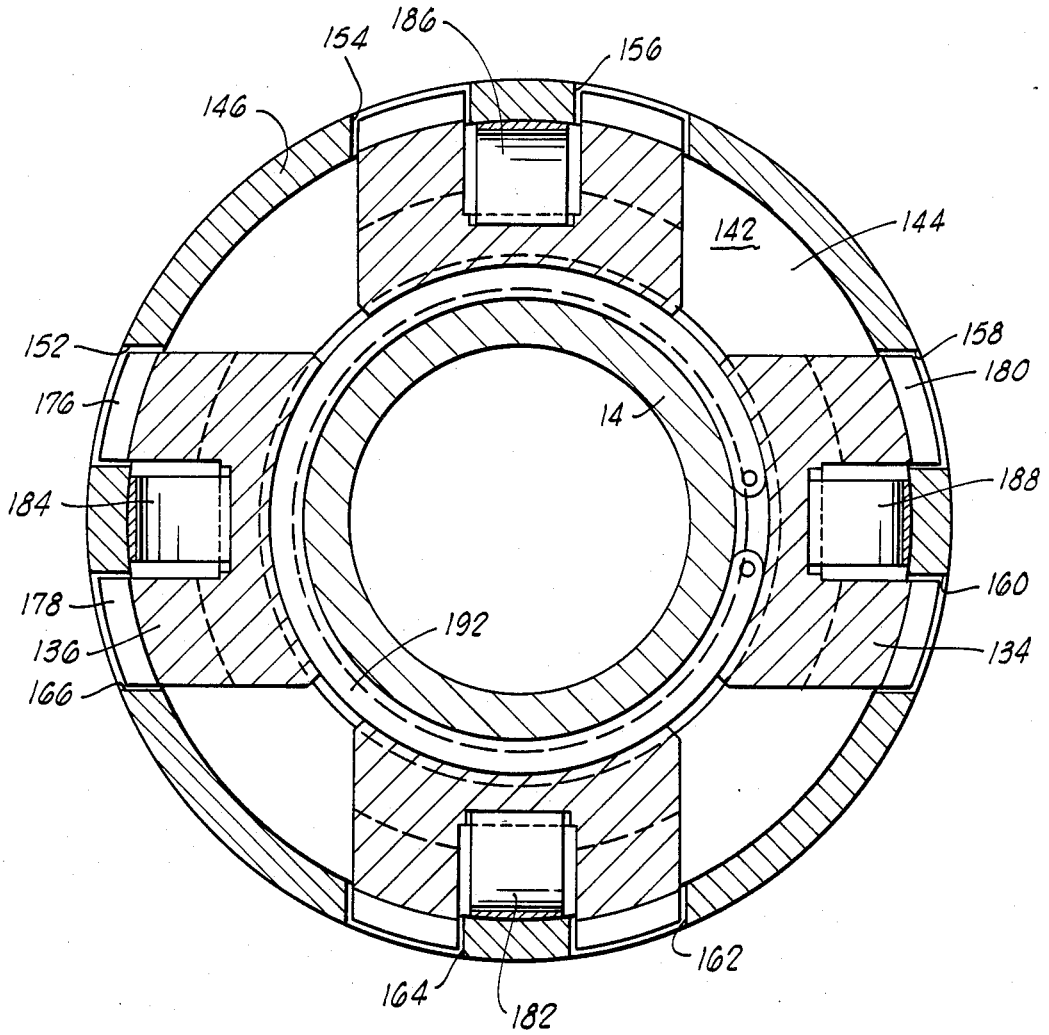
FIG. 2 is a cross-sectional view taken along line 2—2 in FIG. 1C.

With reference to FIG. 2, each of the slips includes a double row of downwardly-directed teeth, like teeth 176, 180 on slip 134, which extends along the length of an associated housing slot. Teeth row 176 and a teeth row 180 on slip 134 are viewable in FIG. 3, which shows the slips engaged with a well bore. Each of the slips also includes a double row of upwardly-directed teeth, like teeth 179, 181 in FIG. 3. Thus, it can be seen that each of the slips is urgable radially outwardly through its associated housing slot in order to engage the teeth thereof with the well bore thereby anchoring packer 10 against both upward and downward movement.

Slip assembly 28 further includes four springs 182, 184, 186, 188 in FIG. 2. The springs are of the type formed from a sheet of flexible metal and comprise elongate strips of such metal. One end of spring 188 is received in the upper end of a slot 190, in FIG. 1C, formed in slip 134 while the lower end of the spring is received in the lower end of slot 190. The middle of the spring is biased against the radially inner surface of housing 146 between slots 158, 160. Thus, spring 188 urges slip 134 radially inwardly thereby preventing the slip teeth from engaging the well bore prematurely. Each of the other springs 182, 184, 186 biases its associated slip radially inwardly in a similar fashion.

Mandrel 14 includes a slot into which a retaining ring 192, viewable in FIG.1C and in FIG. 2, is received. The retaining ring is thus fixed as shown and is restrained from axial or other movement. Retaining ring 192 is referred to herein as a first radially outer mandrel shoulder.

A plurality of shear pins, one of which is shear pin 194, are received through a radial bore in slip housing 146 and through a bore in the radially outer surface of lower spreader cone 144 thus preventing axial movement of the housing relative to the spreader cone.

Spreader cone 144 includes a radially inner shoulder 196. The lower end of the spreader cone is engaged via a threaded connection 198 with lower adapter 18. Set screws 200, 202 are received in bores as shown to prevent threaded connection 198 from becoming unthreaded. A split-ring retainer 204 is received about the circumference of mandrel 14 above threaded connection 20 and is biased against the mandrel by an O-ring 206.

In operation, well packer 10 is assembled at the surface of a well bore in the configuration shown in FIGS. 1A–1C and FIG. 2. Well packer 10 is connected to a tubing string, via threads 22, which includes therein a conventional thermal expansion joint positioned between well packer 10 and the surface of the well. The thermal expansion joint is provided so that when high temperatures are encountered, longitudinal thermal expansion and contraction of the tubing string can be accomodated. If necessary or desirable, a conventional tailpipe may be threadably engaged with threads 24 at the lower end of well packer 10.

The tubing string assembled as described above is lowered into a well bore in which high temperatures will be encountered, such as a well into which steam will be injected. When well packer 10 is at the level in the bore at which the annulus between the tubing string and the bore is to be sealed, further lowering is stopped. Thereafter, the tubing beneath well packer 10 must be temporarily plugged in order to set the packer. Such temporary plugging is known in the art and may be accomplished by using a pumpout ball and seat arrangement mounted in the tubing beneath the tool and set to pump out at some pressure in excess of that required to set the packer. Other methods such as a wire line retrievable blanking plug and seat arrangement positioned in the tubing beneath the packer are known.

After the tubing beneath the packer is temporarily sealed using one of the above-described conventional techniques, pressure inside the tubing string, and thus inside mandrel 14, is increased by pumping into the tubing at the surface of the well. The tubing pressure is communicated via ports 98, 100, in FIG. 1B, to slots 88, 90 and from there to the surfaces of pistons 84, 96 which are in communication with the ends of slots 88, 90. As the pressure increases, piston 84 is urged upwardly into the annular space between mandrel 14 and piston casing 68 while piston 96 is urged downwardly.

As piston 84 moves upwardly, spring 72 compresses and begins urging slip retainer 58 and lower packer shoe support 54 upwardly. When slip retainer 58 first begins upward movement, shear pin(s) 70 breaks thereby permitting additional movement. Shear pin(s) 70 prevents accidential setting of packer element 26 while well packer 10 is being lowered into the bore. Upward movement of slip retainer 58 urges lower packer shoes 48, 50, 52 upwardly which compresses packer element 26 against shoulder 30. Such compression urges packer segments 38, 40, 42, 46 into sealing engagement with both mandrel 14 and the radially inner surface of the well bore. It can be seen that slip assembly 57 prevents any downward movement of lower packer shoe support 54 and thus of lower packer shoes 48, 50, 52 relative to mandrel 14 and therefore tends to maintain the packer element in its sealing condition. In a similar fashion, slip assembly 75 prevents downward movement of the lower end of spring 72 relative to mandrel 14.

After internal mandrel pressure reaches a sufficient level, piston 84 is urged to its uppermost position thereby setting packer 26 as set forth above. After such pressure is reduced to hydrostatic pressure, packer element 26 remains set because internal slip assemblies 57, 75 prevent downward movement of the lower end of packer element 26 and of the lower end of spring 72. Thus, spring 72 remains compressed between slip assemblies 57, 75 thereby continuously biasing packer element 26 into its set condition.

Figure 3:
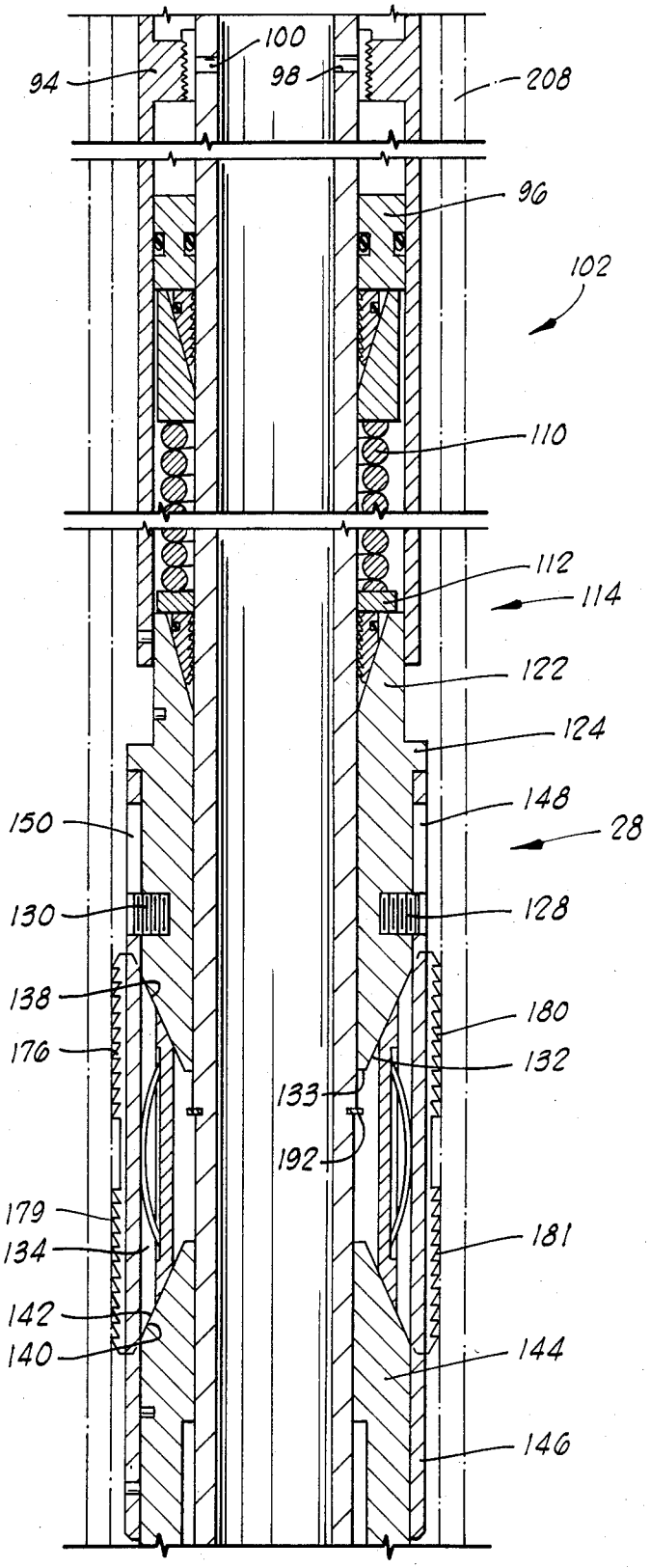
FIG. 3 is a view of a portion of the well packer shown in FIGS. 1A–1C with the slips thereof engaged with a well bore.

While packer element 26 is being set as described above, piston 96 is also moving downwardly in response to internal mandrel fluid pressure to set bi-directional slip assembly 28 in a similar fashion. As can be seen in FIG. 3, piston 96 is urged downwardly responsive to fluid pressure thereby moving internal slip assembly 102 downwardly against spring 110. Spring 110 in turn urges ring 112, internal slip assembly 114, and upper spreader cone 122 downwardly. Such downward action shears pin(s) 126 thereby permitting upper spreader cone 122 to move downwardly relative to piston case 68. Shoulder 124 acts against the upper surface of slip housing 146 thereby urging the slip housing downwardly with upper spreader cone 122. Such downward slip housing movement shears pin(s) 194, in FIG. 1C, thereby permitting the slip housing to move downwardly relative to lower spreader cone 144. As the upper spreader cone approaches the lower spreader cone, surfaces 138, 140 on slip 136 slide against surfaces 132, 142 on upper spreader cone 122 and lower spreader cone 144, respectively. Such action urges slip 136 and each of the other slips radially outwardly against the bias of their associated springs until the slips are in the configuration of FIG. 3. A well casing 208 is shown in dashed-line configuration in FIG. 3 against which the slip teeth, like teeth 176, 180, engage thereby anchoring well packer 10 in the bore.

After tubing string pressure is decreased to hydrostatic pressure, bi-directional slip assembly 28 is maintained in the configuration of FIG. 3 due to the action of internal slip assemblies 102, 114 which prevent upward movement of upper spreader cone 122 and of the upper end of spring 110. Thus, spring 110 is maintained in its compressed condition and thereby continues to urge bi-directional slip assembly 28 into its set condition as shown.

After packer element 26 and bi-directional slip assembly 28 are set as described above, steam may be injected through the tubing into the formation beneath the well packer. During such injection, the metal components of well packer 10 are heated and tend to expand. Longitudinal mandrel expansion tends to reduce the longitudinal compression of packer element 26. However, since spring 72 is maintained in a compressed condition, as mandrel 14 lengthens the spring urges lower packer shoe support 54 and lower packer shoes 48, 50, 52 upwardly thereby maintaining packer element 26 in a sealed condition.

Such mandrel expansion tends to relax bi-directional slip assembly 28 except for the fact that spring 110, in a fashion, similar to spring 72, continues to exert a downward biasing force thus maintaining the bi-directional slip assembly in its fully set condition.

In low temperature sealing, low temperature packer segments 40, 42 tend to provide most of the sealing action. As temperature increases, packer elements 40, 42 melt or otherwise degrade, as described in the Harris et al. patent. In high temperatures, high temperature sealing elements 38, 46 provide the sealing action. As the low temperature packer segments 40, 42 melt, spring 72 maintains packer element 26 in the compressed condition even as the overall length of the packer element decreases due to melting of segments 40, 42.

If it later becomes necessary to remove well packer 10 from the bore, right-hand rotation is applied to the tubing string, and thus to mandrel 14, thereby unthreading threaded connection 20. Thereafter the tubing string and thus mandrel 14, is raised upwardly causing ring 192 to abut against shoulder 133 on the lower end of upper spreader cone 122. Continued lifting of the mandrel pulls the upper spreader cone from beneath surface 138 of slip 136, and from beneath each of the other upper tapered slip surfaces. The biasing action of each slip spring causes the upper portion of each slip to be biased radially inwardly against the mandrel Such biasing allows the slip teeth on the upper portion of each slip to move away from casing 208 thereby disengaging the teeth from the casing.

Upward movement of mandrel 14 causes each of the retaining pins, like pins 128, 130, in upper spreader cone 122 to abut against the upper end of their associated slots, like slots 148, 150, respectively. Continued upward mandrel movement pulls slip housing 146 upwardly until the lower end of each slot 152–166, like lower ends 170, 174 of slots 152, 158, engages the lower end of each slip thereby lifting the slip upwardly and sliding the tapered slip surface, like slip surface 140 on slip 136 from tapered surface 142 of lower spreader cone 144. The slip springs bias the slips inwardly to permit disengagement of the teeth on the lower portion of the slips from the casing.

If sufficient weight is hanging from lower adapter 18, as soon as it is unthreaded from mandrel 14, lower spreader cone 144 may be pulled downwardly thus removing surface 142 from beneath each of the slips. If or when the spreader cone does so drop, shoulder 196 engages split ring retainer 204 to preventing the shoulder and adapter 18 from dropping off the lower end of the mandrel.

Figure 4:
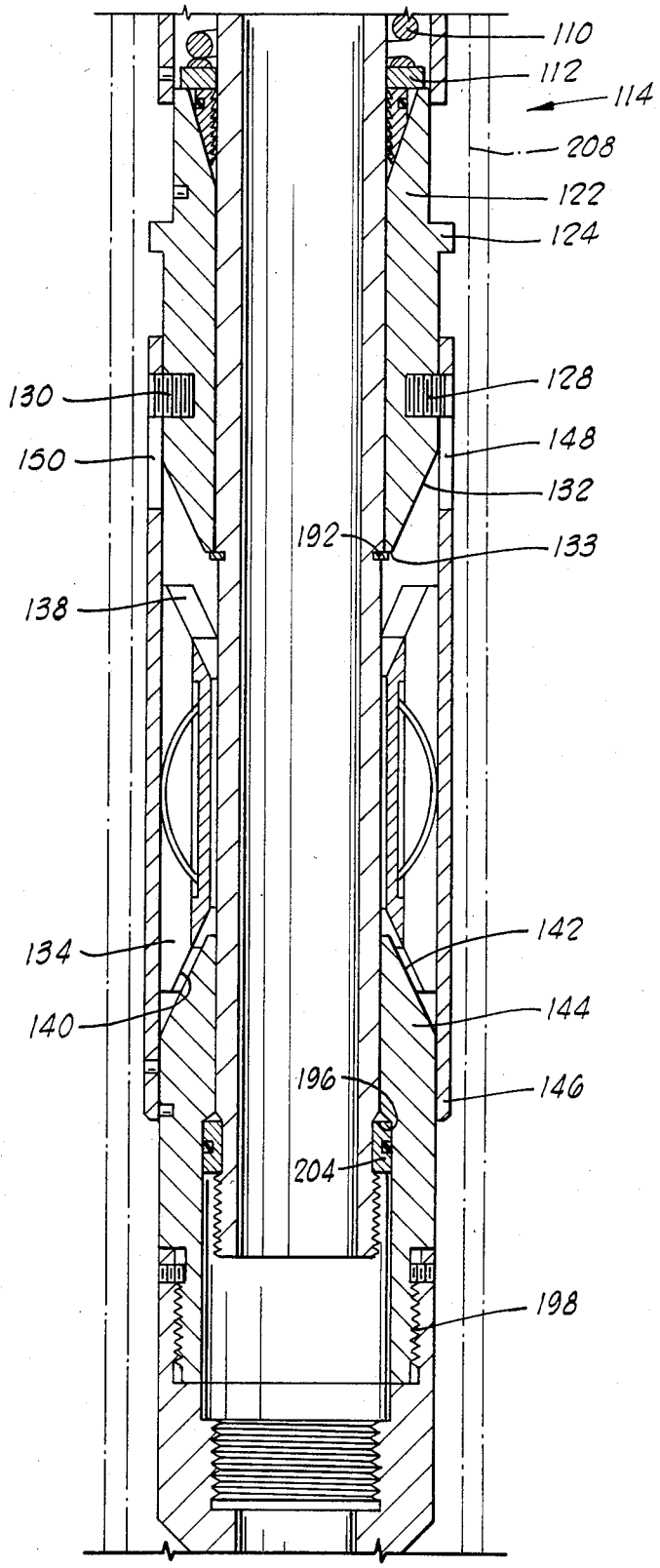
FIG. 4 is a view similar to FIG. 3 with the slips being released from the well bore.

FIG. 4 is a view of a portion of well packer 10 after the slips have been released from the casing as described above. After the slips are in the configuration of FIG. 4, the tubing string may be pulled upwardly to remove well packer 10 from the bore. Although packer element 26 remains in a set condition, it will skid relatively easily in the well bore.

Figure 5:
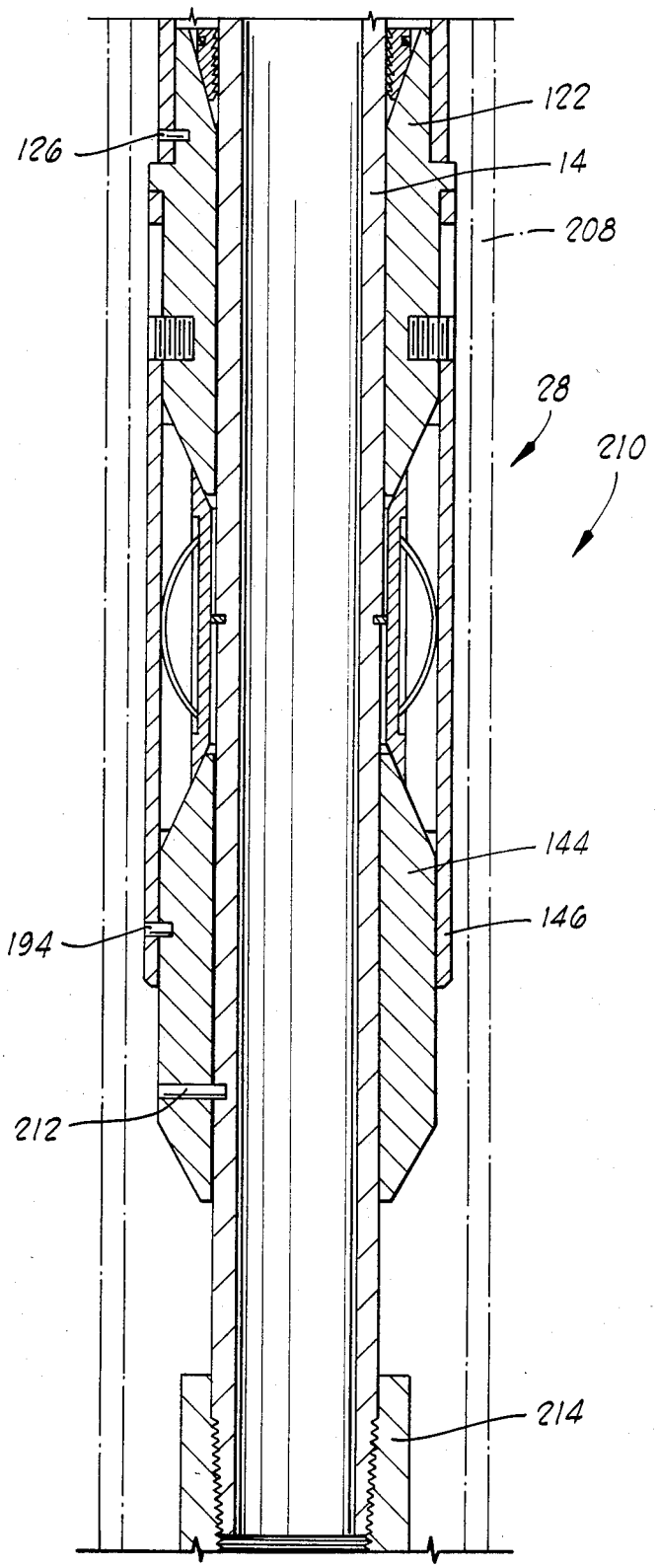
FIG. 5 is a view of a portion of a second embodiment of the invention similar to the view of FIG. 1C.

Indicated generally at 210 in FIG. 5 is the lower end of a well packer, similar to the view of FIG. 1C, illustrating an alternative embodiment of the invention. Structure in FIG. 5 which corresponds to previously-described structure in FIG. 1C is designated by the same numeral as in FIG. 1C. The principal difference between the structure of FIG. 5 and that of FIG. 1C is that lower spreader cone 144 is pinned, via a shear pin 212 to mandrel 14 rather than threadably engaged with lower adapter 18. In FIG. 5 a tubing collar 214 is threadably engaged with the threads on the lower end of mandrel 14.

The manner in which the FIG. 5 well packer is made up in a tubing string and set in a well bore is the same as that described for the embodiment of FIGS. 1–4.

After the FIG. 5 well packer is set in the bore and it is desired to release the packer therefrom, instead of unthreading threaded connection 20 and thereafter pulling mandrel 14 upwardly in order to release bi-directional slip assembly 28, mandrel 14 is simply pulled upwardly. Such pulling shears pin 212 and releases the bi-directional slip assembly as described in connection with well packer 10. Lower spreader cone 144 is prevented from dropping off the lower end of the mandrel by tubing collar 214.

It is to be appreciated that additions and modifications to the above-described embodiments of the invention may be made without departing from the spirit thereof which is defined in the following claims.

I claim:

1. A high temperature retrievable packer for sealing a well bore annulus formed between the casing in the well bore and a string of tubing located therein, comprising:

a mandrel, said mandrel including a first shoulder on the radially outer surface thereof; and a second shoulder located below said first shoulder on the radially outer surface thereof;

a packer element disposed about said mandrel for sealing the annulus between the mandrel and a well bore into which the mandrel is lowered, such sealing occuring in response to compression of said packer element along the longitudinal axis thereof;

a first piston associated with said mandrel and being slideable along the longitudinal axis thereof, said first piston compressing said packer element along the longitudinal axis thereof responsive to an increase in the interior mandrel pressure;

a bi-directional slip assembly disposed about said mandrel for engaging the radially inner surface of said casing of such a well bore, such engaging occurring in response to force applied along the longitudinal axis of said slips, said bi-directional slip assembly including:

a first spreader cone releasably secured to said mandrel, said first spreader cone including a radially inner shoulder thereon, said radially inner shoulder of said first spreader cone for supporting said spreader cone when it is released from engagement from said mandrel by engaging said first shoulder on the radially outer surface of said mandrel;

a second spreader cone;

a bi-directional slip positioned between said spreader cones, said slip being urged radially outwardly as said first spreader cone approaches said second spreader cone; and a slip cover received over said slip, said slip cover having an opening through which said slip can extend, said slip cover further having a longitudinal slot therein for receiving a pin mounted on said second spreader cone and extending radially outwardly therefrom;

and a second piston associated with said mandrel and being slideable along the longitudinal axis thereof, said second piston applying force along the longitudinal axis of said slip assembly in response to an increase in interior mandrel pressure to urge said second spreader cone toward said first spreader cone wherein said second shoulder on said mandrel, said slip cover and said upper spreader cone pin being arranged and contructed to permit releasing said slip by releasing said first spreader cone from said mandrel, pulling upwardly on said mandrel until said second shoulder on said mandrel withdraws said second spreader cone from beneath said slip, and thereafter pulling upwardly on said mandrel until the lower edge of said slip cover opening pulls said slip off of said first spreader cone thereby releasing setting force from said packer element to allow removal of said high temperature retrievable packer from said casing in said-well bore.

2. The high temperature retrievable packer of claim 1 wherein said first spreader cone is threadably engaged with the lower end of said mandrel.

3. The high temperature retrievable packer of claim 1 wherein said first spreader cone is engaged by shear pins with the lower end of said mandrel.

4. The high temperature retrievable packer of claim 1 further comprising:

means for preventing movement of said first piston away from said packer element.

5. The high temperature retrievable packer of claim 4 further comprising:

means for preventing movement of said second piston away from said slip means.

6. The high temperature retrievable packer of claim 4 wherein the means for preventing movement of said first piston away from said packer element comprises an internal slip assembly having a plurality of slip segments.

7. The high temperature retrievable packer of claim 5, wherein the means for preventing movement of said second piston away from said slip means comprises an internal slip assembly having a plurality of slip segments.

8. The high temperature retrievable packer of claim 1 further comprising:

biasing means for continuously urging said packer element into sealing engagement with said casing in said well bore.

9. The high temperature retrievable packer of claim 1 further comprising:

biasing means disposed between said second piston and said slip means.

10. The high temperature retrievable packer of claim 8 further comprising:

means for preventing movement of said packer element towards said second piston.

11. The high temperature retrievable packer of claim 10 wherein said means for preventing movement of said packer element towards said second piston comprises:

a packer shoe associated with said mandrel adjacent said packer element and an internal slip assembly adjacent said shoe and said mandrel for permitting longitudinal movement of said shoe relative to said mandrel in one direction only.

12. The high temperature retrievable packer of claim 9 further comprising:

means for permitting movement of said biasing means disposed between said second piston and said slip means with respect of said slip means only in one direction when said biasing means and said slip means are resiliently biased together when said packer is set.

13. The high temperature retrievable packer of claim 12 wherein said means for permitting movement of said bising means disposed between said second piston and said slip means with respect to said slip means in only one direction when said biasing means and said slip means are resiliently biased together when said packer is set comprises;

an internal slip assembly having a plurality of slip segments to grip said mandrel.

* * * * *